US006986815B2

(12) United States Patent
Eichenberger

(10) Patent No.: US 6,986,815 B2
(45) Date of Patent: Jan. 17, 2006

(54) FLOW SYSTEM FLUSH PROCESS

(75) Inventor: Louis C. Eichenberger, Weatherford, TX (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/337,856

(22) Filed: Jan. 8, 2003

(65) Prior Publication Data

US 2004/0129293 A1 Jul. 8, 2004

(51) Int. Cl.
*B08B 3/12* (2006.01)

(52) U.S. Cl. ..... 134/1; 134/18; 134/22.1; 134/22.11; 134/22.12; 134/22.15; 134/22.18; 134/21; 134/30; 134/37

(58) Field of Classification Search ..... 134/18, 134/22.1, 22.11, 22.12, 22.15, 22.18, 21, 134/30, 37, 1
See application file for complete search history.

(56) References Cited

U.S. PATENT DOCUMENTS 2,222,516 A * 11/1940 Powell et al. ..... 134/10
3,531,323 A * 9/1970 Carpenter et al. ..... 134/1
4,922,937 A * 5/1990 Bloch ..... 134/22.12
5,322,571 A * 6/1994 Plummer et al. ..... 134/22.12

* cited by examiner

*Primary Examiner*—Zeinab El-Arini
(74) *Attorney, Agent, or Firm*—Harness, Dickey & Pierce

(57) ABSTRACT

A method of clearing residue from a fluid conduit includes commencing flush fluid flow through the fluid conduit and injecting a first fluid into the fluid conduit at a first point to induce turbulent flow of the flush fluid. The first fluid is preferably a gas. The method further includes sampling the flush fluid downstream of the first point to confirm the residue is adequately cleared from the fluid conduit.

8 Claims, 4 Drawing Sheets

FLOW SYSTEM FLUSH PROCESS

FIELD OF THE INVENTION

The present invention relates to fluid flow systems, and more particularly to a method of flushing a fluid flow system.

BACKGROUND OF THE INVENTION

Fluid flow systems are implemented in a variety of applications. For example, a power plant requires a water flow system, among many others, to generate steam. A particular fluid flow system can be an open-loop or closed-loop system depending upon the particular application requirements. Such fluid flow systems can transfer water, oil or any other fluid required. Often, the fluid conduits that make up the fluid flow system are made of carbon steel or some other oxidizing metal.

During periods of non-use, debris suspended within the fluid settles at the bottom of the fluid conduits creating a sediment layer. Additionally, other contaminants may be present within the flow system that attach to the walls of the fluid conduits. In the case of steel conduits, oxidization can occur as a result of the fluid's oxygen content. This leads to the creation of a rust layer on the walls of the fluid conduit.

When re-commissioning a dormant fluid flow system, it is necessary to flush the system of dirt, debris, crust and/or rust that has built up. Traditional flushing processes implement a flush fluid flow through the system to dislodge and flush out the dirt and debris. In some instances, mechanical devices, such as a thumper, are attached to the outside of the fluid conduits to induce vibrations in the fluid conduits. The vibrations enhance the flushing process.

Traditional flushing processes are inefficient and have limited effectiveness. In many instances, the flushing process lasts an unreasonably long time and fails to adequately clear the dirt and debris from the system.

SUMMARY OF THE INVENTION

Accordingly, the present invention provides a method of clearing residue from a fluid conduit. The method includes commencing flush fluid flow through the fluid conduit and injecting a first fluid into the fluid conduit at a first point to induce turbulent flow of the flush fluid.

In one feature, the first fluid is a gas.

In another feature, the method further includes sampling the flush fluid downstream of the first point to confirm the residue is adequately cleared from the fluid conduit.

In still another feature, the method further includes injecting a second fluid into the fluid conduit at a second point downstream of the first point to induce turbulent flow of the flush fluid. The first fluid is the same type as the second fluid. The second point is sufficiently downstream of said first point whereby the fluid flow may be laminar upon reaching the second point. The flush fluid is sampled downstream of the second point to confirm the residue is adequately cleared from the fluid conduit.

In yet another feature, the method further comprises setting the flush fluid flow to a maximum flow rate.

In another feature, the method further includes inducing vibrations in the fluid conduit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
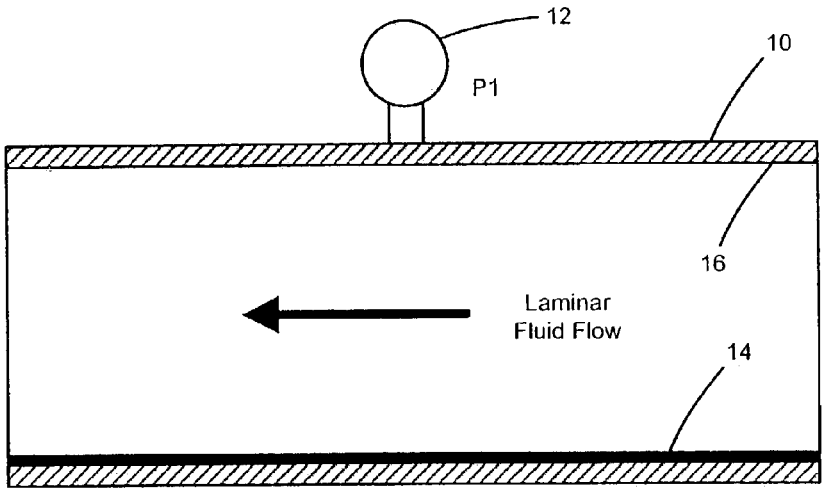
FIG. 1 is a cross-sectional view illustrating a fluid conduit having a laminar fluid flow therethrough.

Referring now to FIG. 1, a fluid conduit 10 is shown having a laminar fluid flow therethrough. An instrument 12 (e.g. pressure or temperature gauge) is positioned on the fluid conduit 10 at a first point P1. The instrument 12 measures a characteristic (e.g. pressure or temperature) of the fluid flow within the fluid conduit 10. A sediment layer 14 rests at the bottom of the fluid conduit 10. Additionally, the inside surfaces 16 of the fluid conduit 10 includes layers of rust and/or crud.

Figure 2:
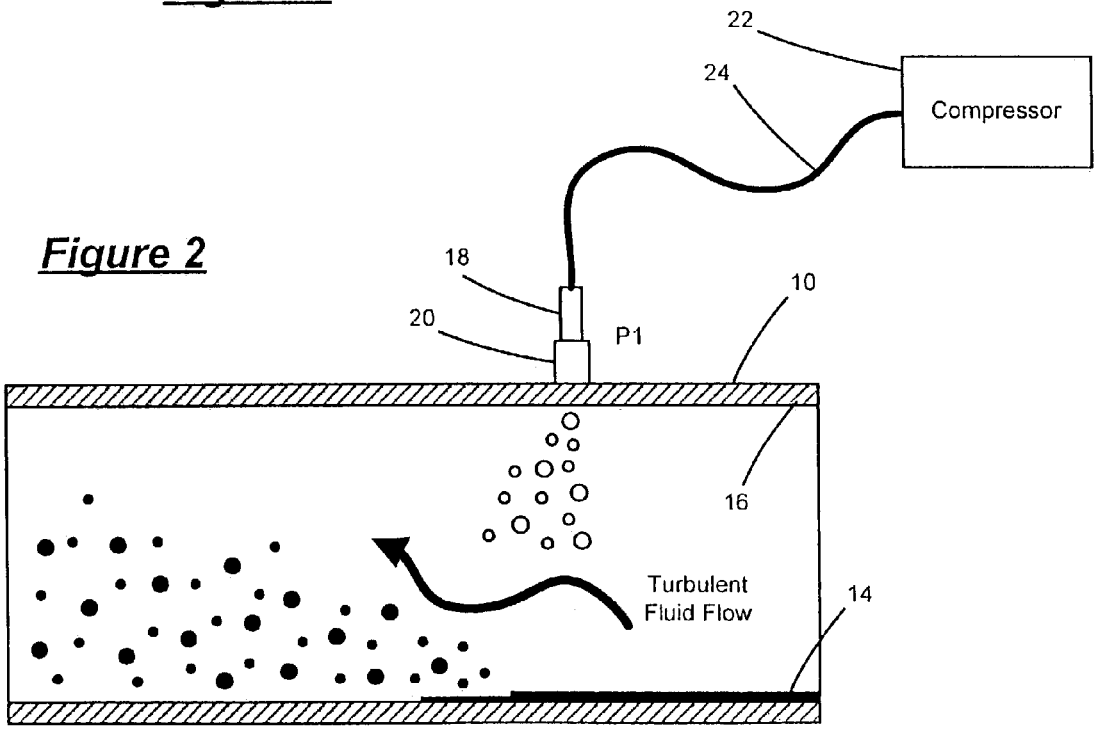
FIG. 2 is the fluid conduit of FIG. 1 including a first injection point to inject a gas according to the present invention.

Referring now to FIG. 2, the instrument 12 is removed and a fluid injector 18 is attached to the fluid conduit 10 at an orifice 20. The orifice 20 enables fluid communication between the fluid injector 18 and the internal area of the fluid conduit 10. It is anticipated that other orifices can be adapted as injection points including, but not limited to, vents and drains. The fluid injector 18 is attached to a compressor 22 via a hose 24. A fluid is injected by the fluid injector 18 to induce turbulent fluid flow in the fluid conduit 10. The injected fluid must be at a higher pressure than the fluid flowing through the fluid conduit 10. The injected fluid is preferably a gas including air. It is appreciated that the type of gas is not limited to air and can include any type of known gas such as nitrogen.

Figure 3:
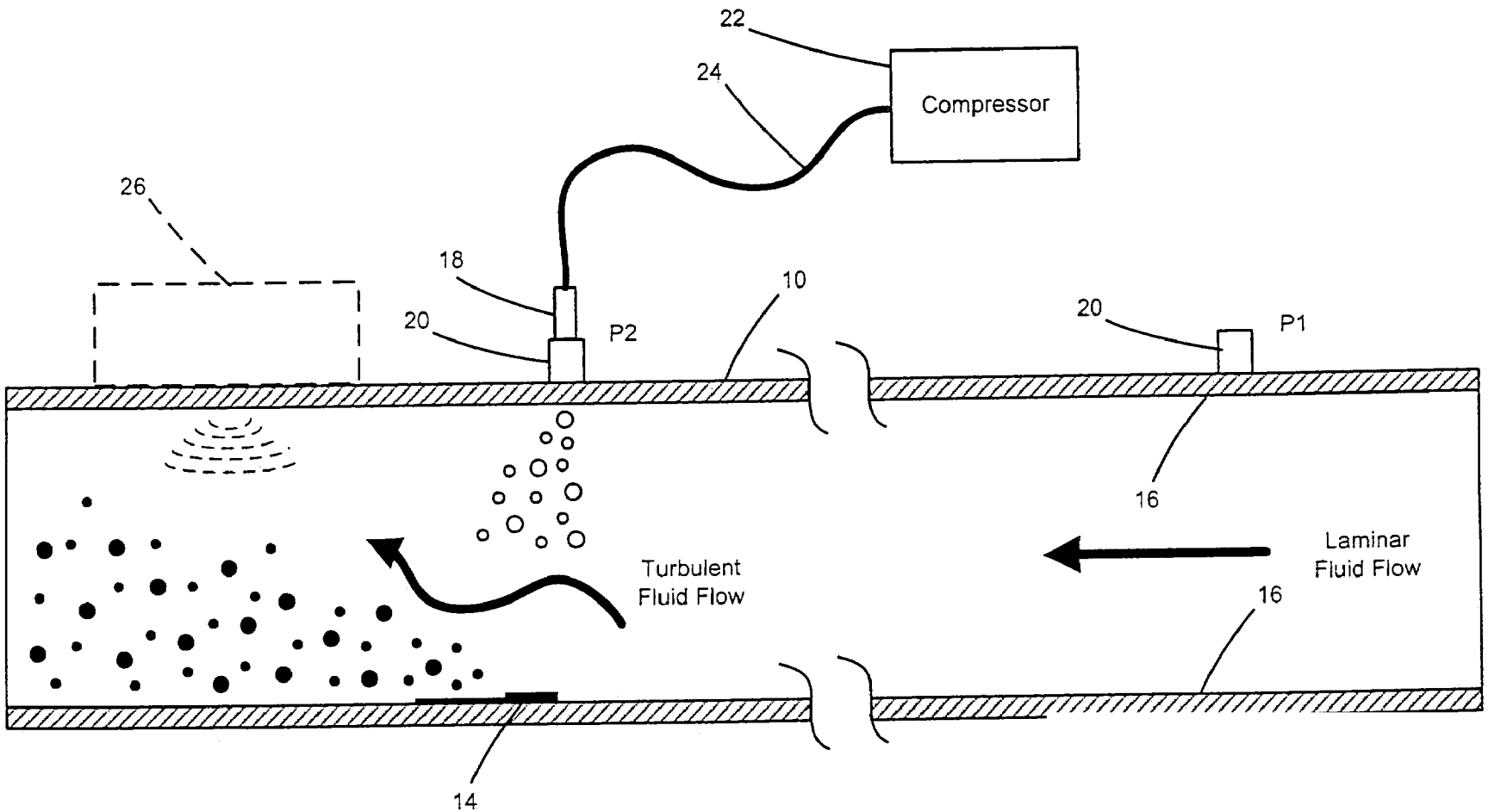
FIG. 3 is a cross-sectional view illustrating an additional length of the fluid conduit of FIGS. 1 and 2 including a second injection point to inject the gas according to the present invention.

Referring now to FIG. 3, the fluid conduit 10 includes a second point P2 located downstream of the first point P1. The turbulent flow induced at the first point P1 has become laminar by the time it reaches the second point P2. The sediment layer 14 and the rust/crud layers have been sufficiently cleared between the first and second points. To clear these layers past the second point P2, the fluid is injected through the second point P2 using the fluid injector 18 as described above.

Optionally, a vibrator or thumper 26 (shown in phantom) can be attached to the outside of the fluid conduit 10 to induce vibrations through the fluid conduit 10. The vibrations enhance the removal of the sediment layer 14 and the rust/crud layers. The thumper 26 is a mechanical device that is powered by either electric or pneumatic means, such as an electric or air motor.

Figure 4:
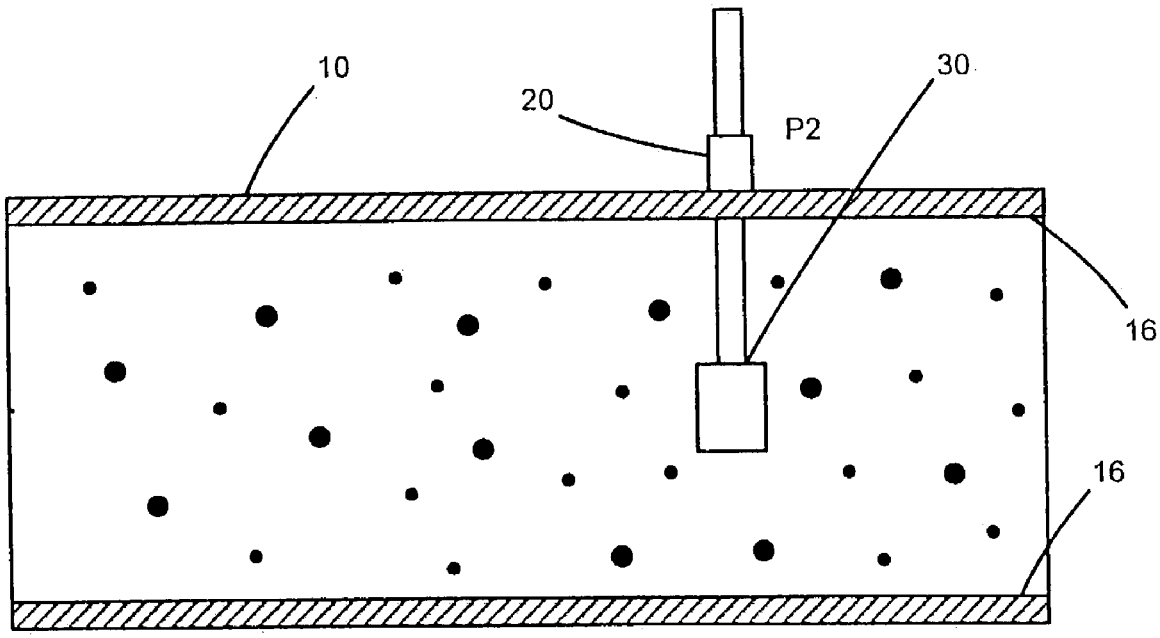
FIG. 4 is a cross-sectional view of the fluid conduit of the preceding Figures including a fluid sampler inserted into the fluid conduit through the second injection point.

The fluid flow through the fluid conduit 10 is tested with fluid injection through the orifice 20 suspended. In this way, the fluid flow through the fluid conduit 10 is representative of normal fluid flow. Through testing it is determined whether the sediment and rust/crud are sufficiently removed from the fluid conduit 10. In the particular embodiment of FIG. 4, a test probe 30 is inserted into the fluid conduit 10 through the orifice 20. Fluid samples are taken and analyzed to determine the quality and size of any debris or other particles present in the fluid. If the fluid quality is sufficient, downstream removal of the sediment and rust/crud is commenced. For example, after a period of time removing the sediment and rust/crud from the first point P1 on downstream, the probe 30 is inserted through the second point P2. A fluid sample is examined. If the fluid sample shows sufficient fluid quality, the flushing process ceases at the first point P1 and commences at the second point P2, as depicted in FIG. 3. However, if the fluid quality is insufficient, the fluid process continues at the first point P1, as depicted in FIG. 2, until achieving the desired fluid quality. In this manner, upstream sections of the fluid conduit 10 are sufficiently flushed prior to commencing the flushing process in downstream sections.

Figure 5:
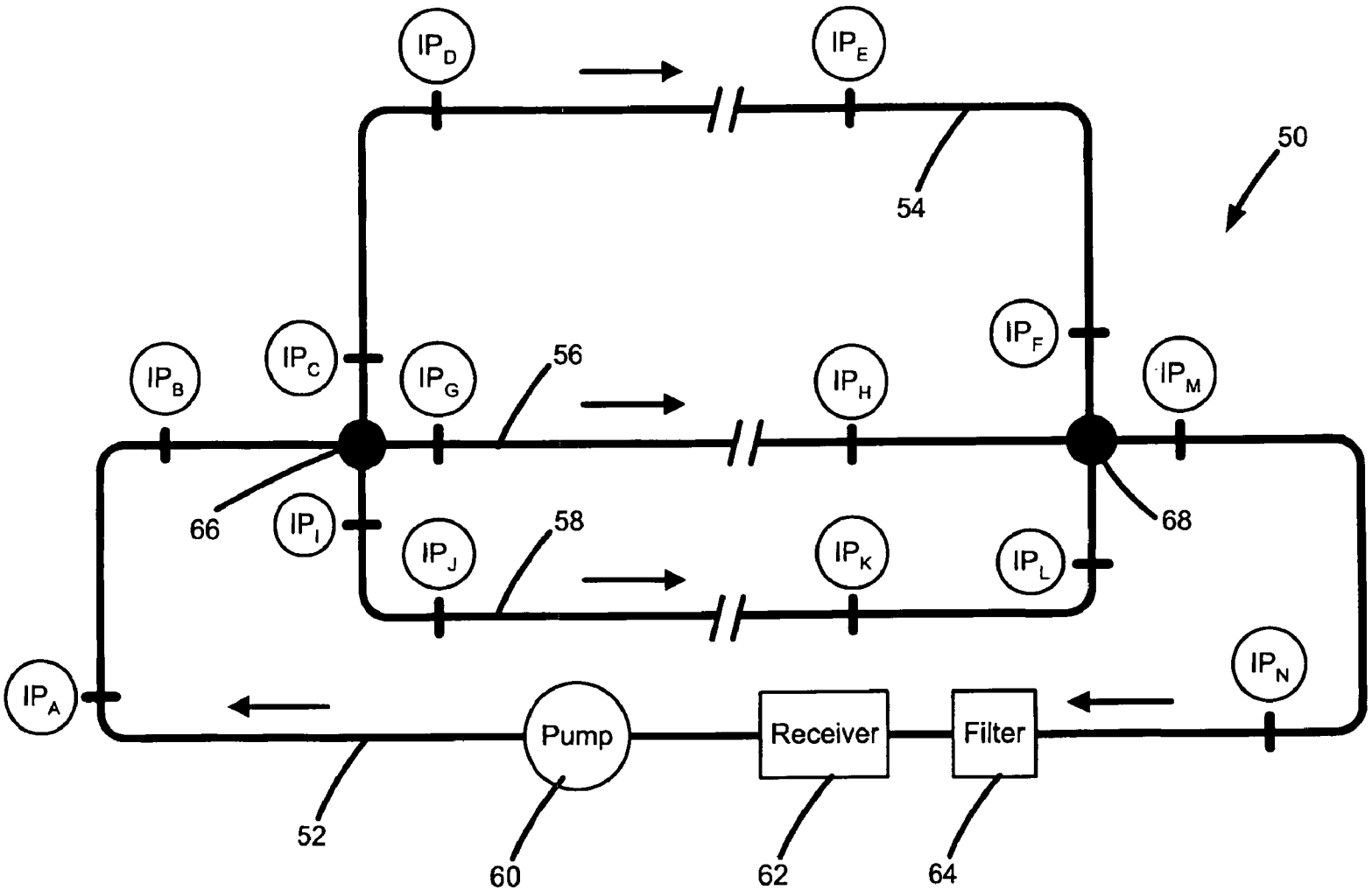
FIG. 5 is a schematic illustration of a closed-loop fluid circulation system including multiple flow paths and injection points according to the present invention.

Referring now to FIG. 5, an exemplary closed-loop fluid flow system 50 is shown. Although the flushing process of the present invention is described with respect to the fluid flow system 50, the fluid flow system 50 is merely exemplary in nature. It is appreciated that the flushing process can be implemented with any fluid flow system including open-loop fluid flow systems. The fluid flow system 50 includes a main loop 52 and three branches 54, 56 and 58, respectively, made up of fluid conduits. The main loop 52 includes a pump 60, a receiver 62 and a filter 64. The pump 60 pumps a fluid through the fluid flow system 50. The returning fluid is filtered through the filter 64 and flows into the receiver 62. The receiver 62 serves as a reservoir from which fluid is drawn by the pump 60. The receiver 62 also separates gas from the liquid fluid. The gas is bled out of the fluid flow system 50 through the receiver 62.

The main loop 52 includes injection points $IP_A$, $IP_B$, $IP_M$ and $IP_N$. The branch 54 includes injection points $IP_C$ through $IP_F$. The branch 56 includes injection points $IP_G$ and $IP_H$. The branch 58 includes injection points $IP_I$ through $IP_L$. The injection points are preferably points where pressure gauges, temperature gauges or other instruments are attached or a vent or drain is present. The respective gauge or instrument is removed and the injector is inserted into the open orifice. In this manner, existing orifices are used and special flushing orifices are not required.

In accordance with the flushing process of the present invention, the fluid injector is initially inserted into $IP_A$. Fluid is injected into the main loop 52 through $IP_A$ to induce turbulent fluid flow therein. As described above, a thumper can also be implemented to induce vibrations in the fluid conduit in the vicinity of $IP_A$. The probe is inserted in $IP_B$ and fluid samples are taken. Prior to taking the fluid samples, the fluid injection is ceased. In this manner, the fluid samples are indicative of normal system operation. If the fluid samples are not of a sufficient quality, the flushing process remains at $IP_A$. If the quality is sufficient, the fluid injector is removed from $IP_A$ and the gauge or instrument is reattached to $IP_A$. The flushing process then continues at $IP_B$. The flushing process at the injection points is carried out using various injection and system fluid flow rates. These flow rates are varied during the flushing process to determine the most effective combination of injection and system fluid flow rates.

The flushing process at $IP_B$ commences similarly as described with regard to $IP_A$. Fluid is injected into the main loop 52 through $IP_B$ to induce turbulent fluid flow therein and a thumper is optionally implemeted. The main loop 52 splits to form the three branches 54, 56, 58 downstream of $IP_B$. The fluid samples are taken around the split 66. If the fluid samples are not of a sufficient quality, the flushing process remains at $IP_B$. If the quality is sufficient, the fluid injector is removed from $IP_B$ and the gauge or instrument is reattached to $IP_B$. The flushing process then continues in the branches.

Preferably, one branch is flushed prior to flushing the next branch. The flushing process commences in the first branch 54 at $IP_C$ of the first branch 54. Fluid is injected into the first branch 54 through $IP_C$ to induce turbulent fluid flow therein and a thumper is optionally implemeted. Fluid samples are taken at $IP_D$ of the first branch 54. If the fluid samples are not of a sufficient quality, the flushing process remains at $IP_C$. If the quality is sufficient, the fluid injector is removed from $IP_c$ and the gauge or instrument is reattached. The flushing process then continues through the remaining injection points of the first branch 54 until the first branch 54 is sufficiently cleared.

The same process is repeated for the second and third branches 56, 58 as described for the first branch 54. The branches rejoin the main loop at a convergence point 68. Once the branches 54, 56, 58 are sufficiently flushed, flushing of the main loop 52 continues at $IP_M$. The flushing process at $IP_M$ commences similarly as described above with the fluid samples taken at $IP_N$. The flushing process then commences at $IP_N$ with fluid samples taken at the filter 64.

The filter 64 filters the sediment and rust/crud that is dislodged by the flushing process. The filter 64 is periodically cleaned or replaced to ensure sufficient fluid flow therethrough. As a result of the gas injection at the various injection points, an undesirable gas build-up could occur. However, the receiver 62 separates the injected gas from the fluid flowing from the system 50. The gas is bled from the system 50 by the receiver 62.

The specific type of gas used depends on several factors including the type of fluid system and cost. For example, air compressors or an air supply system may already be present at the location. If the air pressure of an existing system is insufficient, pressure boosters or high-pressure compressors can be temporarily implemented. Although air may be less expensive, the oxygen content of the system fluid may be increased by using air. Thus, a gas, such as nitrogen, could be implemented to eliminate any corrosive effects of increased oxygen content. Additionally, an alternative to air would be desired in the case of a fluid such as oil flowing through the system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of clearing residue from a fluid conduit, comprising:

commencing flush fluid flow through said fluid conduit;

injecting a first fluid into said fluid conduit at a first point downstream of a source of said flush fluid flow to induce turbulent flow of said flush fluid;

injecting a second fluid into said fluid conduit at a second point downstream of said first point to induce turbulent flow of said flush fluid; and clearing said residue from said fluid conduit.

2. The method of claim 1 wherein said first fluid is a gas.

3. The method of claim 1 further comprising sampling said flush fluid downstream of said first point to confirm said residue is adequately cleared from said fluid conduit.

4. The method of claim 1 wherein said first fluid is common to said second fluid.

5. The method of claim 1 wherein said second point is sufficiently downstream of said first point whereby said flush fluid flow is not laminar upon reaching said second point.

6. The method of claim 1 further comprising sampling said flush fluid downstream of said second point to confirm said residue is adequately cleared from said fluid conduit.

7. The method of claim 1 further comprising setting said flush fluid flow to a maximum flow rate.

8. The method of claim 1 further comprising inducing vibrations in said fluid conduit.

* * * * *